United States Patent [19]

Thomas

[11] 4,260,423

[45] Apr. 7, 1981

[54] KILN TAR BINDER AND METHOD OF PRODUCING IT

[75] Inventor: James L. Thomas, Hamilton Sq., N.J.

[73] Assignee: FMC Corporation, Philadelphia, Pa.

[21] Appl. No.: 124,053

[22] Filed: Feb. 25, 1980

[51] Int. Cl.[3] ..... C08L 95/00

[52] U.S. Cl. ..... 106/273 R; 208/44; 260/28 R

[58] Field of Search ..... 106/273 R; 208/44; 44/23

[56] References Cited

U.S. PATENT DOCUMENTS

| | | | |
|---|---|---|---|
| 2,314,641 | 3/1943 | Wolf | 202/34 |
| 2,567,136 | 9/1951 | Vloeberghs | 44/21 |
| 3,117,918 | 1/1964 | Batchelor et al. | 202/26 |
| 3,152,978 | 10/1964 | Fierce et al. | 208/44 |
| 3,275,585 | 9/1966 | Baum et al. | 208/44 |
| 3,301,803 | 1/1967 | Schick et al. | 208/44 |
| 3,440,073 | 4/1969 | Fowler et al. | 106/273 R |
| 3,544,494 | 12/1970 | Schmidt et al. | 208/44 |
| 4,030,982 | 6/1977 | Gorin et al. | 201/6 |
| 4,050,990 | 9/1977 | Lorenz | 201/5 |
| 4,156,595 | 5/1979 | Scott et al. | 44/10 C |

*Primary Examiner*—Harold D. Anderson
*Assistant Examiner*—Amelia B. Yarbrough
*Attorney, Agent, or Firm*—Robert D. Jackson; Frank Ianno

[57] ABSTRACT

A bituminous binder, useful in the production of form coke, is obtained by reacting kiln tar recovered from a form coke oven with formaldehyde in the presence of a mineral base until the ASTM Ring and Ball softening point is at least about 58° C. Calcium hydroxide is the preferred base; formalin or paraformaldehyde is used as a source of formaldehyde.

8 Claims, No Drawings

KILN TAR BINDER AND METHOD OF PRODUCING IT

This invention relates to bituminous binders, particularly modified kiln tars and their preparation.

In U.S. Pat. Nos. 3,140,241 and 3,140,242 there is described a high strength, chemically reactive form coke product which is useful in metallurgical processes. For example, it can serve as a carbonaceous reductant in ore refining including iron smelting. The product can be manufactured from a wide variety of coals including low-grade, non-coking types such as lignites. This is a particularly important feature since coking coals are becoming increasingly scarce and more expensive to mine and transport.

In producing the form coke aforesaid, bituminous coal, including coking and non-coking coals, of a particle size less than 6 mesh and preferably less than 16 mesh with the average particle size in the range of from 40 to 60 mesh, is heated in the presence of oxygen, which may be derived from the coal itself in the case of the so-called high oxygen-containing coals, i.e., coals having an excess of 15% by weight of oxygen, to a temperature high enough to drive off substantially all moisture but below that at which substantial amounts of tar-forming vapors evolve. Thereafter the coal particles from this heat treatment are heated to a higher temperature at which tar-forming vapors are evolved and for a time interval sufficient to effect polymerization of the heated coal particles and evolution therefrom of substantially all of the tar-forming vapors to produce a char of markedly lower volatile combustible material content than the parent coal and substantially free of tar-forming vapors. This char is heated to a still higher temperature to produce calcined char particles having a volatile combustible contact below about 3% which are blended with a bituminous binder and formed into green briquettes. Calcined char obtained by the treatment aforesaid is a strong, dense, abrasive-resistant, homogeneous carbonaceous material which bonds strongly with bituminous binders during curing and coking of the green briquettes.

The calcined char is mixed with the binder in the proportions by weight of from 75% to 90% calcined char to 25% to 10% binder. All mesh sizes are in terms of the United States Sieve Series (United States Bureau of Standards).

The blend of calcined char and binder of blown tar is compressed into green briquettes which are then cured in an atmosphere containing oxygen to bring about copolymerization of the binder and the char so as to make the briquettes strong and infusible. The cured briquettes are cooked to give briquettes suitable for metallurgical purposes. The resulting briquettes are of uniform composition, i.e., the carbon derived from the calcined char and that derived from the bituminous binder are indistinguishable.

Preferred bituminous binders are coal tar pitch or pitches produced by dehydration and oxidation of tars recovered from the carbonization. This is commonly effected by air blowing the decanted tars at a temperature above the condensation temperature of steam. Such treatment reduces the water content of the tar to about 0.5% and increases its viscosity to the desired softening point. A softening point can be obtained within the range of 38° C. to 107° C., but 54° C. to 66° C. (ASTM Ring and Ball) is preferred for use as a form coke binder.

In addition to carbonizer tar, the form coke process aforesaid also yields kiln tar which is recovered by quenching the kiln tar vapors with a water spray and the resulting condensate fed into decanters. Kiln tar constitutes about 10% to 15% by weight (dry basis) of total tar production. As recovered, the kiln tar contains about 15 to 35% water and tends to separate from the aqueous phase into two phases. One of these is heavier than water and is commonly referred to as heavy or sinking tar. The lighter phase, which floats on water is commonly referred to as light or floating tar; a considerable portion of the tar exists as an emulsion.

While unsuitable as a binder per se, kiln tar can be combined with carbonizer tar and blends containing up to about 30% by weight of kiln tar have been used in form coke production. However, kiln tar produced in form coke kilns responds much more slowly to airblowing than carbonizer tar. Apparently, the tarry components, which contain more aromatics than carbonizer tar, are relatively inert and do not polymerize when heated in the presence of air. While it is true that air blowing of kiln tar does increase its viscosity, the treatment can be quite lengthy—as much as 40 hours or more in order to arrive at a Ring and Ball softening range suitable for briquetting, i.e., about 58° C. Because it requires such extensive blowing periods and is generally tedious to work up, the tendency is to discard kiln tar. This not only creates pollution problems, but represents a loss of fixed carbon contributed by the kiln tar binder. Moreover, kiln tar can reduce the need to purchase binder where the form coke plant yields an excess of char.

Manifestly, there is an urgent need for improved utilization of kiln tar in form coke production.

It is accordingly, the principal object and purpose of the present invention, to provide a bituminous composition, derived from kiln tar, useful as a binder in form coke production. It is also an object of the invention to provide a method of preparing said composition.

The objects aforesaid can be realized by blowing kiln tar with formaldehyde in the presence of a base. Generally speaking, the reaction conditions are the same as when blowing tar in the known manner except for the presence of the base and formaldehyde. Thus, kiln tar recovered by quenching the tar vapors from form coke ovens and containing about 10 to 30% by weight of water, is heated under essentially atmospheric pressure with formaldehyde and a base at a temperature sufficient to drive off the water and to bring the Ring and Ball viscosity in the range of about 58° C.

The formaldehyde can be used as the pure gas but is more conveniently supplied from precusors such as the 37% aqueous solution sold commercially under the trade name "Formalin" or paraformaldehyde, a solid trimer of formaldehyde.

Exemplary bases include the alkali metal and alkaline earth metal hydroxides and carbonates although any number of basic substances, both organic and inorganic, should be suitable. A preferred base is calcium hydroxide.

One preferred method of the preparing of the kiln tar binder of the invention comprises heating a mixture of aqueous kiln tar, formalin and calcium hydroxide wherein the formalin amounts to about 1 to 2% by weight and the formalin about 1 to 2% by weight, the remainder of the mixture being the aqueous kiln tar.

During the initial heating period, water is evolved and the temperature will remain slightly in excess of the boiling point of water, i.e. above 100° C. As more water is driven off, the temperature tends to rise. After all water is removed the temperature of the reaction is allowed to reach about 120° C. and held at this temperature until the viscosity of the tar reaches the desired Ring and Ball viscosity. Where the product is to be used as the binder in form coke, a Ring and Ball viscosity of at least about 58° C. is desirable.

In carrying out the kiln tar treatment aforesaid, the calcium hydroxide is added as a slurry to the aqueous kiln tar which has previously been heated to about below 100° C., preferably about 90° C. To the resulting mixture is added the formalin preferably in increments to avoid excess foaming.

Although formalin is a convenient and inexpensive source of formaldehyde, some of the formaldehyde gas may be driven off before completely reacting with the tar. This may result in longer blowing times or require the use of pressure vessels.

Formaldehyde losses can be minimized by using paraformaldehyde, which is a solid melting at 150° C. It remains in the reaction mixture during the period of tar blowing and apparently releases formaldehyde at the rate needed to react with the tar.

In preparing form coke briquettes herein, the bituminous binder of the invention is mixed with particulate carbon and the resultant mixture briquetted to give green briquettes which are then cured and coked. The manufacture of form coke briquettes is a generally known technique and is documented extensively in periodicals and treatises pertaining to coal technology. Preferably, form coke briquettes are produced following the procedure of U.S. Pat. Nos. 3,140,241 and 3,140,252, which have been previously cited and summarized.

Reference is now made to the following specific procedures and examples.

Procedure for Determining Softening Point of Bituminous Materials

1. Heat the tar sample, while stirring, to a temperature not more than about 116° C.
2. Place the ring from the ring and ball apparatus on a plate and pour a sufficient amount of the heated sample into the ring so as to leave an excess upon cooling.
3. Allow to cool for at least 30 minutes and then cut off the excess with a slightly heated knife or spatula.
4. Place the ring containing the sample in its support, set the support in an 800 cc beaker filled with freshly boiled distilled water cooled to room temperature and allow the sample to remain submerged at this temperature for at least 15 minutes.
5. Place the thermometer in the beaker and support it in a manner such that the bulb of the thermometer is on the same level with the sample material in the ring.
6. Place a steel ball in the center of the material in the ring and begin stirring the water. Continue this stirring until the completion of the determination.
7. Apply heat to the beaker in such a manner that the temperature of the water is raised 5° C. per minute. Any substantial variation in this rate shall be cause for rejecting the result and repeating the test.
8. Note the temperature on the thermometer at the instant the steel ball or sample material touches the lower horizontal plate of the support and record this temperature as the softening point.

Where the softening point of the tar is below room temperature after pouring the material into the ring as in (2) above, the plate and ring are immersed in water sufficiently cold to harden the material and allowed to remain therein for at least 15 minutes. After cutting off the excess material, the ring is placed in its support in an 800 cc beaker filled with equally cold water and the procedure above followed beginning with step (5).

Procedure for Determining Coking Values

The coking value of a form coke binder is an indication of the fixed carbon it provides during curing and coking of briquettes prepared therefrom. Such coking values can be determined by heating a specimen of the binder at 200° C. in a covered curcible. Coking values are calculated using the following formula:

$$\% \text{ Coking Value } (CV) = \frac{\text{Weight of Residue}}{\text{Initial Weight}} \times 100$$

The higher the CV value, the higher the yield of fixed carbon from the binder.

Procedure for Preparing the Bituminous Binder of the Invention

A mixture of 500 g of kiln tar having a water content of 18.0%, formalin or paraformaldehyde $(CH_2O)_3$ and calcium hydroxide were placed in a 1000 ml. round bottom flask equipped with a stirrer, thermometer and baffle plates. The mixture was heated slightly in excess to drive off the water (dehydration) and then at a higher temperature until the viscosity reached the desired Ring and Ball softening point.

Using the procedure aforesaid, several examples were prepared. The reaction conditions and results are set forth in Table I. As will be observed, much shorter blowing times are required to reach a suitable Ring and Ball viscosity compared to the prior art. Thus, example 1 gives a high Ring and Ball in a mere 4.5 hours; the minimal Ring and Ball of about 58° C. was reached in even less time. In example 2, only $Ca(OH)_2$ was added and same reactivity is shown. However, although the reaction time is fairly short, 5.3 hours, the Ring and Ball is much lower than when using both $Ca(OH)_2$ and formaldehyde. Example 3 was especially effective, as shown by the high Ring and Ball and rapid increase in the viscosity as measured in centistokes.

The improved results of example 3 are thought to be atributable to the use of paraformaldehyde, which being a solid is not expelled from the reaction mixture to the extent that formalin is. Paraformaldehyde is the preferred source of formaldehyde where minimal blowing periods are desired. Example 4 also demonstrates the efficiency of using paraformaldehyde. Example 5 was blown for 4 hours but the minimal Ring and Ball of 58° C. was reached in much shorter time; also some of the formaldehyde was expelled before the reaction was complete. Example 6 is similar to example 5. Examples 7 and 8 illustrate the prior art in which kiln tar is blown without the additives of the invention. The blowing times are much longer than with the process of the invention and then only a relatively medium Ring and Ball viscosity was attained. Examples 9 and 10 show that the process of the invention can be carried out with a mixture of kiln and raw tars to give satisfactory Ring and Ball values in very short blowing periods.

The results aforesaid clearly demonstrate that when kiln tar is blown under optimum conditions of the invention, such as in examples 1, 3 and 4, blowing times are drastically reduced thereby making it practical to utilize this by-product tar in form coke manufacture.

TABLE I

| Example | Tar Type | Additives % by Wt of Mixture | Method of Addition | Reaction Temp. °C. | Total Time Hours |
|---|---|---|---|---|---|
| 1 | Kiln | 2 $Ca(OH)_2$<br>1.5 $(CH_2O)_3$ | $Ca(OH)_2$ at start<br>$(CH_2O)_3$ at 132° C. | 132 | 4.5 |
| 2 | Kiln | 2 $Ca(OH)_2$ | at start | 120 | 5.3 |
| 3 | Kiln | 2 $Ca(OH)_2$<br>1.5 $(CH_2O)_3$ | $Ca(OH)_2$ to start<br>added $(CH_2O)_3$ at 4,000 centistokes | 120 | 5.25 |
| 4 | Kiln | 2 $Ca(OH)_2$<br>0.5 $(CH_2O)_3$ | $Ca(OH)_2$ to start<br>$(CH_2O)_3$ in two increments | 120 | 6.5 |
| 5 | Kiln | 2 $Ca(OH)_2$<br>1.5 of 37% $CH_2O$ | $Ca(OH)_2$ to start<br>$CH_2O$ added in three increments | 120 | 14.0 |
| 6 | Kiln | 1 $Ca(OH)_2$<br>1.5 of 37% $CH_2O$ | Same as Example 5 | 120 | 9.0 |
| 7 | Kiln | None | | 120 | 21.6 |
| 8 | 50/50 Raw*/Kiln | None | | 120 | 16.5 |
| 9 | 50/50 Raw/Kiln | 2 $Ca(OH)_2$<br>.48 of 37% $CH_2O$ | Added before dehydration | 120 | 4.0 |
| 10 | 50/50 Raw/Kiln | 2 $Ca(OH)_2$<br>1.0 of 37% $CH_2O$ | $Ca(OH)_2$ to start<br>$CH_2O$ added in two increments | 121 | 5.5 |

*The raw tar is low temperature tar obtained by the fluidized bed carbonization of coal as disclosed in U.S. Pat. No. 3,140,241, supra.

| Example | Tar Type | Final Centistokes | Final Ring & Ball °C. | Final Coking Value | Remarks |
|---|---|---|---|---|---|
| 1 | Kiln | 6,500 | 79 | 50.5 | Air at 4.0 SCFH during trial |
| 2 | Kiln | 6,000 | 64 | | Stopped air at 120° C. |
| 3 | Kiln | 20,000** | 79 | 48.8 | Heat to 132° C. to dehydrate, air stopped at 121° C. |
| 4 | Kiln | 12,000 | 69 | 50.0 | Heat to 132° C. to dehydrate, air stopped at 121° C. |
| 5 | Kiln | 13,500 | 70 | 52.4 | Heat to 132° C. to dehydrate, air stopped at 121° C. |
| 6 | Kiln | 14,000 | 62 | 49.6 | — |
| 7 | Kiln | *** | 65 | | Heat to 132° C. dehydrate, air blow continued |
| 8 | 50/50 Raw*/Kiln | 9,000 | 67 | | Dehydrate to 132° C. continue air blow at 3.5 SCFH |
| 9 | 50/50 Raw/Kiln | 10,000 | 65 | | Dehydrate to 132° C. then stopped air |
| 10 | 50/50 Raw/Kiln | 9,000 | 68 | | Dehydrate to 132° C. then stopped air |

*The raw tar is low temperature tar obtained by the fluidized bed carbonization of coal as disclosed in U.S. Pat. No. 3,140,241, supra.
**Viscosity increased from 4,000 to 20,000 cts. in 10 minutes.
***Instrument failure; no reading.

I claim:

1. A bituminous composition of matter prepared by heating and air blowing quenched kiln tar, recovered from a form coke kiln, with formaldehyde in the presence of a base at a temperature sufficient to dehydrate the tar and continuing the heating and air blowing until the Ring and Ball melt viscosity reaches at least about 58° C.

2. The composition prepared according to claim 1 wherein the base is calcium hydroxide.

3. The composition prepared according to claim 2 wherein the formaldehyde is obtained from formalin (37% aqueous formaldehyde).

4. The composition prepared according to claim 2 wherein the formaldehyde is obtained from paraformaldehyde.

5. A method of producing a bituminous composition comprising heating and air blowing quenched kiln tar recovered from a form coke kiln, in the presence of a formaldehyde precursor compound selected from the class consisting of formalin and paraformaldehyde said heating and blowing being continued until the tar is dehydrated and the Ring and Ball melt viscosity reaches at least about 58° C.

6. The method according to claim 5 wherein the formaldehyde precursor is about 2% by weight of the mixture of formalin.

7. The method according to claim 5 wherein the formaldehyde precursor is about 2% by weight of the mixture of paraformaldehyde.

8. The method according to claim 6 or 7 wherein the base is about 2% calcium hydroxide.

* * * * *